US006048176A

United States Patent [19]

Deininger

[11] Patent Number: 6,048,176

[45] Date of Patent: Apr. 11, 2000

[54] REGULATING DEVICE FOR A HYDROSTATIC POSITIVE DISPLACEMENT UNIT

[75] Inventor: Horst Deininger, Hörstein-Alzenau, Germany

[73] Assignee: Linde Aktiengesellschaft, Germany

[21] Appl. No.: 09/030,211

[22] Filed: Feb. 25, 1998

[30] Foreign Application Priority Data

Feb. 25, 1997 [DE] Germany ..... 197 07 469
Dec. 4, 1997 [DE] Germany ..... 197 53 866

[51] Int. Cl.[7] ..... F04B 1/26; F04B 1/12; F01B 3/00

[52] U.S. Cl. ..... 417/222.1; 417/269; 92/12.2

[58] Field of Search ..... 417/222.1, 269, 417/270, 271; 91/505, 506; 92/12.2

[56] References Cited

U.S. PATENT DOCUMENTS 4,232,587 11/1980 Kline ..... 91/499
4,478,136 10/1984 Heiser et al. ..... 91/506
4,986,383 1/1991 Evans ..... 180/165
5,807,076 9/1998 Kawaguchi et al. ..... 417/228
5,881,629 3/1999 Gollner et al. ..... 91/505

*Primary Examiner*—Thomas N. Moulis
*Assistant Examiner*—Mahmoud M. Gimie
*Attorney, Agent, or Firm*—Webb Ziesenheim Logsdon Orkin & Hanson, P.C.

[57] ABSTRACT

A regulating device for a hydrostatic positive displacement unit, such as an axial piston machine employing the swash plate principle, includes a control valve which pressurizes a regulating piston which determines the stroke volume or the displacement volume of the positive displacement unit. An electric-hydraulic regulating device having a simple construction is provided with the control valve in the form of a slide valve which can be actuated electrically. In one configuration of the invention, the slide valve can be actuated by a stepper motor.

18 Claims, 6 Drawing Sheets

REGULATING DEVICE FOR A HYDROSTATIC POSITIVE DISPLACEMENT UNIT

BACKGROUND OF THE INVENTION

1. Field of the Invention

The present invention relates to a regulating device for a hydrostatic positive displacement unit, such as an axial piston machine employing the swash plate principle, with a control valve which pressurizes a regulating piston which determines the stroke volume or the displacement volume of the positive displacement unit.

2. Background Information

During the operation of hydrostatic positive displacement units, it has been found to be advantageous if the stroke volume or the absorption volume can be adjusted by changing the inclination of a tilting yoke, such as a swash plate, to correspond to different operating conditions. The prior art discloses mechanical or hydraulic regulating devices which can be actuated and controlled mechanically, hydraulically or electrically.

Hydraulic regulating devices have at least one regulating piston which is engaged with a tilting yoke, such as a swash plate, and the tilting angle of this body determines the stroke volume or the absorption volume of the positive displacement unit. The regulating body is pressurized by a control valve which generates a control pressure.

To improve the control and regulation of the regulating device, the prior art discloses that the regulating device can be actuated electrically. For this purpose, the prior art discloses systems which have a proportional valve which is actuated by a proportional magnet.

In such a regulating device, the proportional magnet converts an electrical control signal into a magnetic force which deflects a pressure relief valve against the force of a spring. The pressure relief valve is connected to a pressure source and generates a control pressure as a function of the deflection. The control pressure deflects a spring-loaded control piston, the travel of which is transmitted by a mechanical intermediate element to a control valve which is located on the tilting yoke. The control valve is thus piloted by the control pressure and is actuated by the mechanical intermediate element. From a supply pressure, the control valve generates a control pressure which is used to pressurize the regulating piston of the hydraulic regulating unit, thereby regulating the tilting yoke. The control travel is transmitted back to the control valve by a mechanical linkage, wherein—as a function of the distance traveled by the control piston—the control valve is once again closed when the tilting yoke reaches the desired inclination.

To produce the tilting angle on the tilting yoke of the positive displacement unit by the electrical control signal, these systems require five conversions in the signal chain. Each of these conversions is subject to deviations within the specified tolerances and each requires additional components. Friction also occurs in the spring-loaded components and is reflected these systems in the form of hysteresis. The fact that the control valve is located directly on the tilting yoke also increases the cost and complexity of the supply pressure line and of the lines which lead to the regulating piston.

SUMMARY OF THE INVENTION

The object of the invention is to make available an electrical-hydraulic regulating device which has simple construction, high precision and high reliability. This object can be accomplished by forming the control valve of an electrically actuated slide valve. The present invention converts an electrical control signal into an inclined position of the tilting yoke with a minimum of hydraulic and mechanical intermediate elements.

The electrical control signal actuates the control valve which produces the control pressure on the regulating piston. The deflection of the control valve effects a control pressure which, on the regulating piston, produces the desired deflection of the tilting yoke. The electrical control signal therefore effects a deflection of the control valve which generates a control pressure which, through the regulating piston, determines the tilting angle of the tilting yoke. As a result of the elimination of the piloting of the control valve by a control pressure, in this direct actuation of the control valve the signal chain requires only three conversions of the electrical control signal to achieve the desired position of the tilting yoke. A control valve in the form of a slide valve represents a simple and economical valve which makes it possible to regulate the tilting yoke with a high degree of precision and reliability.

In one embodiment of the invention, the slide valve can be actuated by a stepper motor. The electrical signal for the actuation of the stepper motor consists of counting pulses which are reflected regardless of friction factors in the angular travel of the output shaft of the stepper motor.

The slide valve may have a valve body which can be displaced longitudinally in a sleeve, with the valve body connected to the output shaft of the stepper motor to generate a linear movement of the valve body, whereby the valve body has at least one piston flange which actuates an annular groove which is located on the sleeve. The annular groove is connected to the regulating piston. When the stepper motor is actuated, it becomes possible to produce a control pressure in a simple manner to pressurize the regulating piston.

The valve body can be actuated in a variety of ways. For example, the output shaft of the stepper motor can be provided with a gear wheel which is engaged in a toothed rack which is connected to the valve body. The output shaft of the stepper motor may be non-rotationally connected to a cam plate and the cam plate connected to a driver element which is provided for the actuation of the valve body. In this case, the cam plate represents a transmission element which converts the rotational movement of the stepper motor into a translation movement which is suitable for driving the valve slide. The driver element is connected to the valve body of the slide valve, and is used to transmit the translation movement to actuate the valve body of the slide valve.

It is appropriate if the cam plate is a link, in particular a spiral-shaped groove, which is connected to the driver element. In this case, the driver element is moved along the connecting link when the cam plate rotates. As a result, it becomes possible in a simple manner to convert a rotational movement of the cam plate into a translation movement of the valve body.

In this case, it is advantageous if the link has areas with different gradients. In that case, for example the area of the link in which the control valve is in the zero position can be a low gradient. The zero position of the control valve corresponds to the position of the tilting yoke in which the tilting yoke is not deflected. When the stepper motor is actuated, the valve body of the control valve is initially deflected only slightly as a result of the low gradient of the link. It is therefore possible to extend the zero position of the control valve, which facilitates the mechanical calibration effort required for the accurate definition of the zero position. Because the gradient of the link determines the axial deflection of the valve body, there is a correspondingly small axial deflection on account of an area on the link which has a low gradient on the valve body of the control valve for a given angular movement of the stepper motor. As a result, it also becomes possible to achieve a high degree of precision in the setting of the control valve.

In one embodiment, the driver element is a pin which is located in a transverse boring of the valve body and is engaged with the cam plate by the portion projecting out of the transverse boring, whereby the sleeve is mounted so that it can move longitudinally in a housing boring, and is connected to the sleeve by a component which is non-rotationally connected to the tilting yoke. When there is a rotational movement of the cam plate, the pin moves the valve body in the axial direction, as a result the control edges formed by the annular grooves and the piston flanges in the slide valve are exposed and the regulating piston is pressurized with the control pressure. The movement of the tilting yoke is fed back to the sleeve of the slide valve, which sleeve is mounted so that it can move longitudinally in a housing boring. As a result of the connection of the sleeve with the tilting yoke, the sleeve is deflected axially corresponding to the movement of the tilting yoke, whereupon the control edges of the slide valve are closed when the desired tilted position of the tilting yoke is reached. A servo-control device is therefore made available in which the stepper motor defines a set point value for the deflection of the tilting yoke and the set point value on the slide valve is compared to the measured value of the deflection of the tilting yoke.

In this case, the sleeve may be provided on its outside periphery with a groove in which the component which is non-rotationally connected to the swash plate is engaged. It thereby becomes possible, in a simple manner, to obtain feedback on the movement of the tilting yoke to the sleeve of the control valve.

In a regulating unit in which the valve body has two piston flanges, each of which actuates an annular groove which is located on the sleeve and is connected to a regulating piston, the valve body may be mounted so that it can move longitudinally in a longitudinal boring which runs all the way through the sleeve. The longitudinal boring may be connected on its axial ends with a boring which is connected to a supply line. The sleeve, in an area located between the annular grooves, may have a notch which is connected to a reservoir. The groove may be located in the area between the annular grooves and the transverse boring may be located on the valve body. The result is a slide valve which has a simple construction, because no additional annular grooves are required on the sleeve for the connection with the supply line and a reservoir. The connection with the supply line is thereby made via the longitudinal boring, and the connection with the reservoir is made via a notch which is located on the sleeve.

In an additional embodiment, the driver element is a lever which, on one end, has a pin which is engaged with the connecting link of the cam plate, and on the opposite end is connected to a component which is non-rotationally connected to a tilting yoke. The valve body has an annular groove, and the lever is located between the groove walls of the annular groove. When the stepper motor is actuated, the lever is moved by the pin which is engaged with the cam disc around the end which is connected to the tilting yoke and is initially stationary. The valve body is axially deflected by the movement of the lever. The feedback indicating the position of the tilting yoke is also accomplished by the lever which, for this purpose, is tilted around the end which is engaged with the cam plate and correspondingly moves the valve body in the closing direction. It is thereby possible to provide a servo-control device using simple means.

Such a configuration, in which the valve body has two piston flanges, each of which actuates an annular groove which is located on the sleeve and is connected to a regulating piston, includes the valve body mounted so that it can move longitudinally in a longitudinal boring of the sleeve, and the annular groove is molded on the valve body in an area which projects out of the longitudinal boring, wherein on the sleeve there is an annular groove which is connected to a supply line which is located axially between the annular grooves which are connected to the regulating pistons, and the longitudinal boring is in communication at its axial ends with a reservoir. The result is that a regulating valve is made available, the construction of which is simple and economical, because no additional notches are required for the location of the lever on the sleeve.

Pressure can appropriately be applied to the valve body of the slide valve by a spring which is located inside the sleeve. Consequently, the driver element which moves the valve slide is connected to the cam plate without any play or clearance.

A device may be provided which brings the slide valve into a zero position. It is thereby guaranteed that the control valve will be retracted into the zero position, in the event of a power failure, for example, and thus the tilting yoke will also be deflected into the zero position.

Furthermore, a device may be provided which monitors the zero position of the output shaft. It thereby becomes possible to monitor the zero position of the output shaft if the stepper motor does not convert the electrical counting pulses into a deflection of the slide valve. It is thereby always possible to correct the zero position in safety routines.

The device which brings the slide valve into the zero position or monitors the slide valve may be a coil spring which is oriented coaxially to the output shaft of the stepper motor and, on the ends, has two leg ends which project radially, whereby between the ends of the spiral spring there is a stop peg which is non-rotationally connected to the housing and a peg which is connected to the cam plate. When the stepper motor is actuated, the peg which is connected to the cam plate is deflected with respect to the stop peg which is non-rotationally connected to the housing and thus the spiral spring is stretched. When the stepper motor is idle, the cam plate is moved back into the zero position by the force of the spring. The control valve is also moved into the zero position by the driver element which is engaged with the cam plate.

The slide valve and the stepper motor can also be located separately from the tilting yoke on the housing of the axial piston machine, as a result of which the construction expense for the control pressure line and the lines leading to the regulating piston can be reduced significantly. The longitudinal axis of the slide valve can thereby be oriented at a right angle to the axis of rotation of the axial piston machine and to the tilting axis of the tilting yoke, and the longitudinal axis of the stepper motor can be oriented parallel to the tilting axis of the tilting yoke.

The regulating device requires less space if the longitudinal axis of the slide valve is oriented at right angles to the axis of rotation of the axial piston machine and to the tilting axis of the tilting yoke, and the longitudinal axis of the stepper motor is oriented parallel to the axis of rotation of the axial piston machine.

The invention is described in greater detail below with reference to the exemplary embodiments which are illustrated schematically in the accompanying figures.

DETAILED DESCRIPTION OF THE PREFERRED EMBODIMENTS

Figure 1:
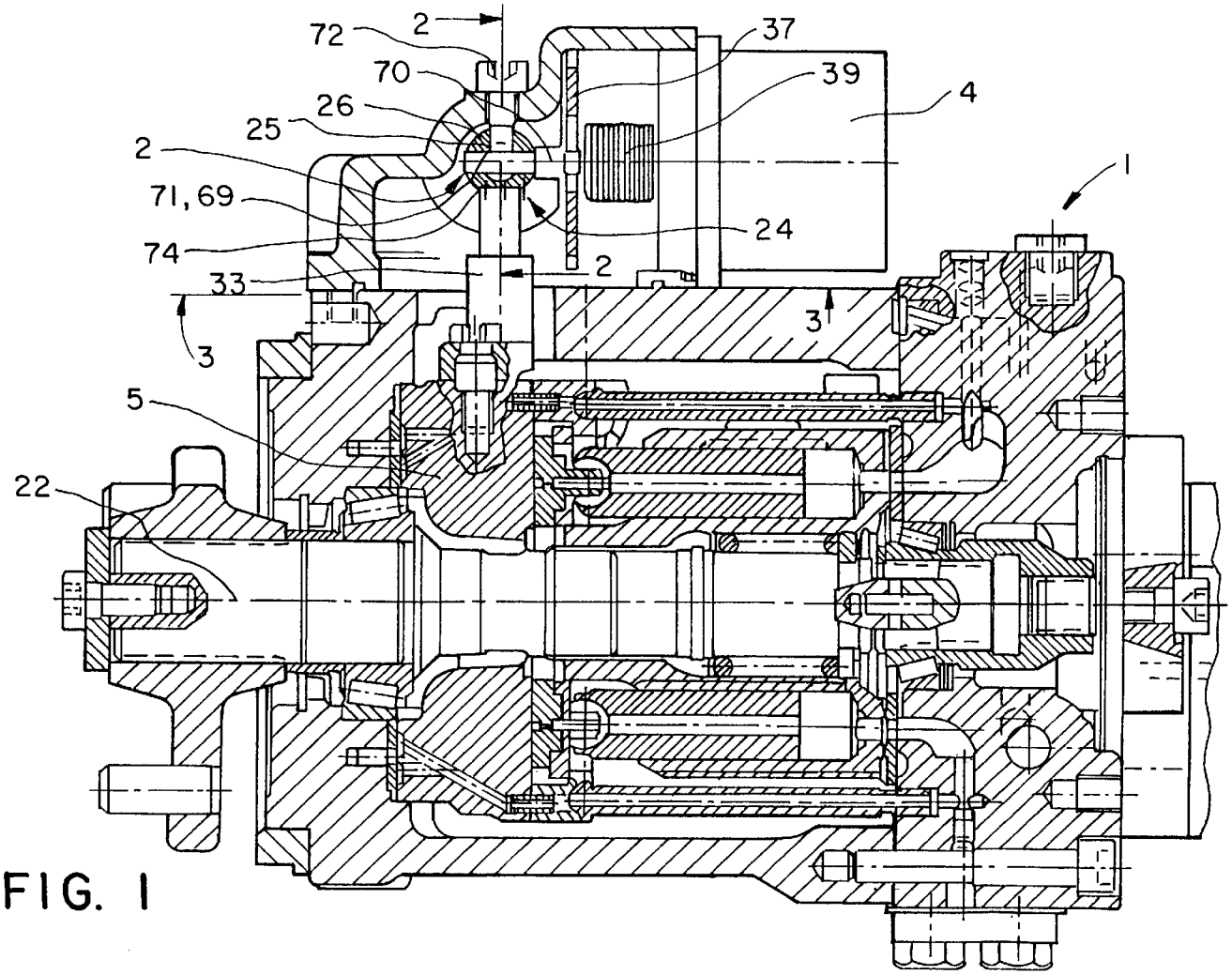
FIG. 1 shows an axial section view through an axial piston machine according to the present invention with a control valve in the form of a slide valve.

FIG. 1 shows an axial piston machine 1 with an electrically actuated control valve 2 in the form of a slide valve 24. The slide valve 24 can be actuated by a stepper motor 4. The tilting yoke 5, which is a swash plate, can be adjusted in terms of its inclination by a plurality of regulating pistons (not shown) which are located on both sides of a tilting axis of the swash plate.

In this case, the longitudinal axis of the slide valve 24 is oriented at a right angle to the axis of rotation 22 of the axis piston machine 1 and at a right angle to the tilting axis of the tilting yoke 5. The stepper motor 4 is fastened with reference to its longitudinal axis parallel to the axis of rotation of the axial piston machine 1 on the housing.

Figure 2:
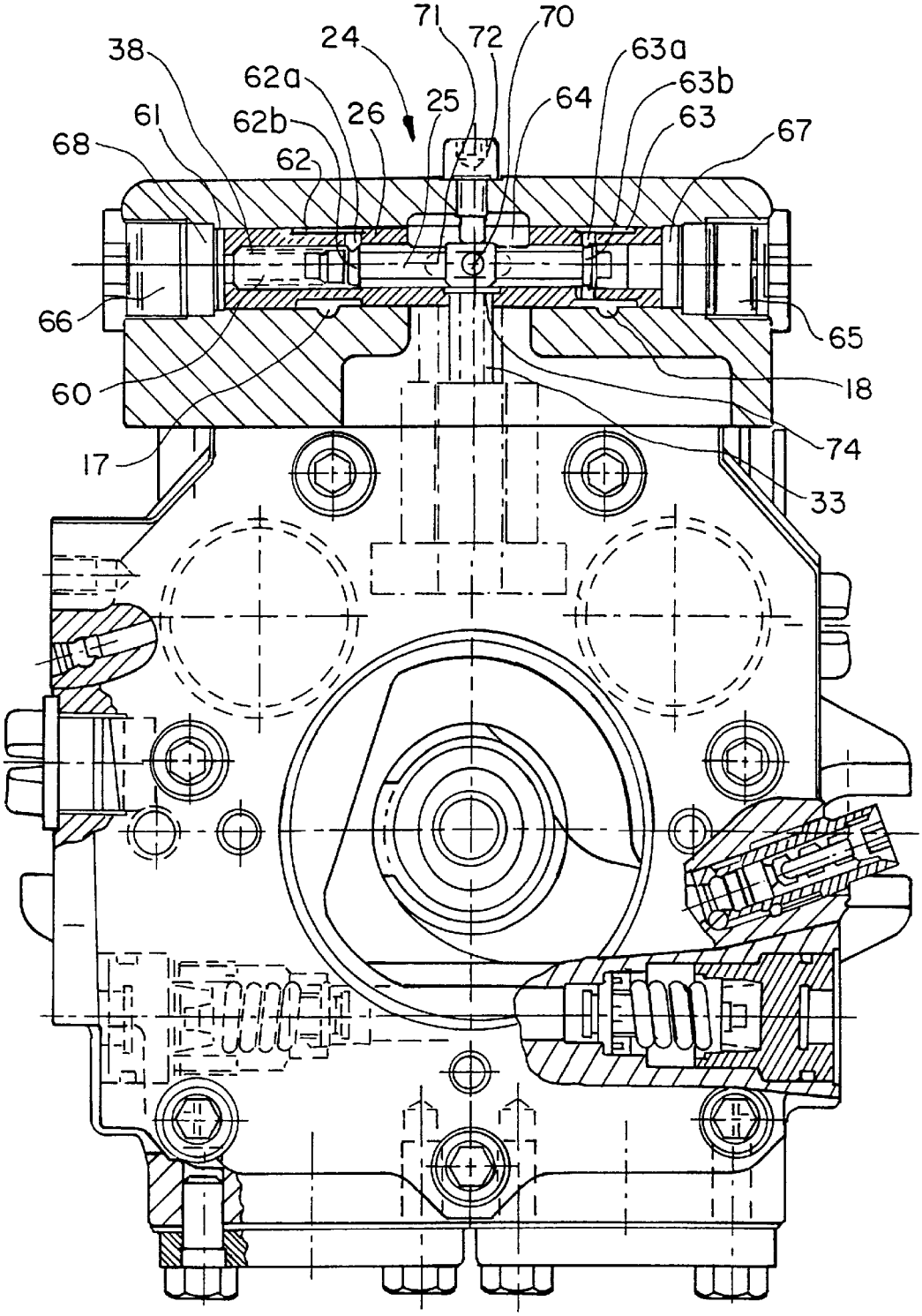
FIG. 2 shows a cross section view along line 2—2 in FIG. 1.

The slide valve 24, as shown in FIGS. 1 and 2, has a valve body 25 which is mounted so that it can move longitudinally in a longitudinal boring 60 of a sleeve 26. The sleeve 26 is also mounted so that it can move longitudinally in a boring 61 in the housing which boring is closed by closing screws 65 and 66. In the sleeve 26 there are annular grooves 62, each of which proceeds from transverse borings 62*a* and 63*a*, which borings merge into the longitudinal boring 60. On the valve body 25 there are piston flanges 62*b* and 63*b* which actuate the control edges formed by the transverse borings 62*a* and 63*a*. The annular grooves 62 and 63 are connected to the lines 17 and 18 leading to the regulating pistons (not shown in this figure). The regulating pistons can be located, for example, on both sides of the tilting axis of the tilting yoke 5. The lines 17 and 18 are thereby in connection with the regulating pistons which are located on either side of the tilting axis.

Figure 4:
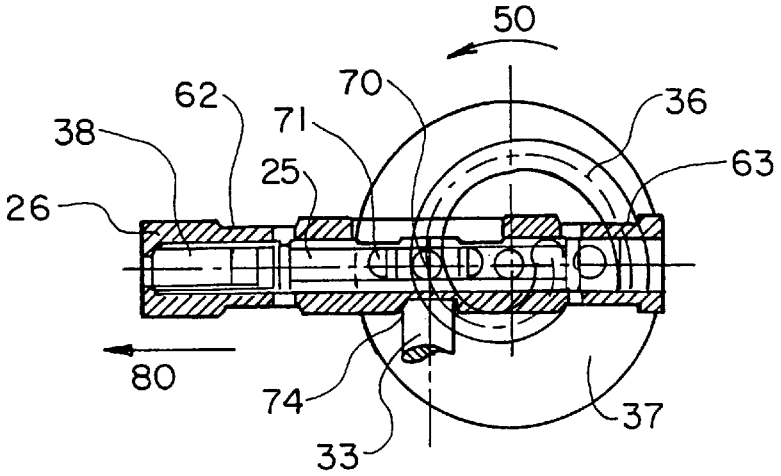
FIG. 4 shows the slide valve with the cam plate in a cross section view along line 4—4 as shown in FIG. 3.

In the central portion of the sleeve 26 there is a notch 64 which connects the longitudinal boring 60 with the interior of the housing of the axial piston machine 1. The outer portions 67 and 68 of the longitudinal boring 61 are connected to a supply line. The valve body 25, in the central portion, has a transverse boring 69 in which there is a pin 70. On the end which projects out of the transverse boring 69, the pin 70 is guided as shown in FIG. 4 in a link 36 which is a spiral-shaped groove in a cam plate 37. The cam plate 37 is thereby non-rotationally connected to an output shaft 19 of a stepper motor 4. On the sleeve 26, in the same plane as the transverse boring 69, there is a slot 71 so that the pin 70 extends from the cam plate 37 through the slot 71 and the transverse boring 69. The pin 60 is therefore housed in the slot 71. A screw 72 which is engaged on the sleeve 26 in the notch 64 prevents a rotation of the sleeve 26. To provide feedback on the movement of the tilting yoke 5, there is a groove 74 on the outside periphery of the sleeve 26, in which a component 33 which is non-rotationally connected to the tilting yoke 5 is engaged. To ensure the mounting of the valve body 25 without any play relative to the sleeve 26, pressure is applied to the valve body 25 by a spring 38 which is located in the boring 60 of the sleeve 26.

Figure 3:
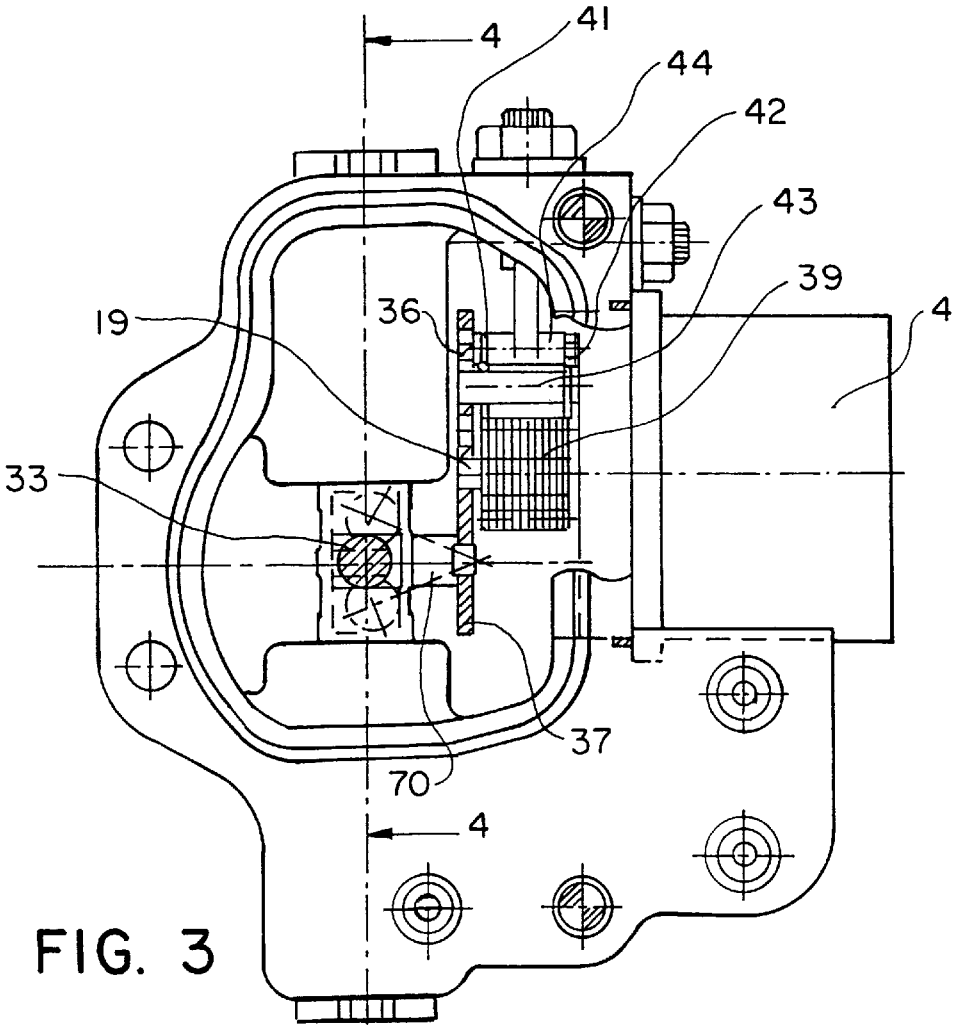
FIG. 3 shows a cross section view along line 3—3 in FIG. 1.

Coaxial to the output shaft 19 of the stepper motor 4, as shown in FIG. 3, there is a coil spring 39. The coil spring 39 has two free ends 41, 42 which project in the radial direction of the spring 39. The ends 41 and 42 are biased toward one another. Between the ends 41 and 42 there is a pin 43 which is non-rotationally connected to the cam plate 37 and a stop pin 44 which is non-rotationally fastened to the housing of the axial piston machine 1. The ends 41, 42 are thereby connected to the pin 43 which is connected to the cam plate 37, and also to the stop pin 44 which is connected to the housing.

When the regulating device is actuated, an electrical control signal formed from counting pulses is converted in the stepper motor 4 into an angle of rotation of the output shaft 19 which corresponds to the number of counting pulses. The cam plate 37 which is connected to the output shaft 19 is also deflected by a corresponding angle of rotation, e.g. in the direction 50. The pin 70 connected to the valve body 25 of the slide valve 24 is thereby guided in the link 36 and moves the valve body 25 of the slide valve 24 in the direction 80. The sleeve 26 is connected by the component 33 to the still stationary tilting yoke 5. The pin 60 is therefore moved along the slot 71 located in the sleeve 26, whereupon the valve body 25 is axially deflected relative to the sleeve 26 in the direction 80. The line 17 connected to the annular groove 62 is thereby connected via the transverse boring 62*a* and the piston flange 62*b* with the interior of the sleeve 26 and thus via the notch 64 with the housing. Simultaneously, the piston flange 63*b* opens a connection of the line 18 connected to the annular groove 63 via the transverse boring 62*b* into the interior of the sleeve 26, so that there is a connection with the outer portion 67 which is connected to a supply line. The area 67, which for example carries the pump pressure of a feed pump, is thereby connected to the line 18, whereupon the tilting yoke 5 of the axial piston machine 1 is deflected. The sleeve 26 of the slide valve 24 is tracked by the component 33 in the axial direction corresponding to the movement of the tilting yoke 5, so that when it reaches the tilting angle set on the stepper motor 4, the piston flanges 62*b* and 63*b* are closed by the sleeve 26, and thus the tilting of the tilting yoke 5 is ended. On account of the movable sleeve 26, the tilting angle of the tilting yoke 5 is therefore reported directly to the control valve 24, and compared to the deflection of the valve body 25.

The coil spring 39 guarantees the zero position of the output shaft 19 of the stepper motor 4 and thus the zero position of the slide valve 24. The free end 41 which is fastened by the peg 43 to the cam plate, is deflected correspondingly when the stepper motor 4 is actuated, and stretches the coil spring 39. As soon as there is no longer any signal being fed to the stepper motor 4, the cam plate 37 is rotated back by the peg 43, by the force of the coil spring 39, into the starting position. The valve body 25 of the slide valve 24 is also returned to the zero position by the driver element which is in the form of a pin 70.

FIGS. 5 to 8 illustrate an additional embodiment of an axial piston machine 1 with a control valve in the form of a slide valve 24, wherein the longitudinal axis of the slide valve 24 is oriented at right angles to the axis of rotation 22 and to the tilting axis of the axial piston machine 1. The stepper motor 4 is oriented with its longitudinal axis parallel to the tilting axis of the tilting yoke 5 of the axial piston machine 1.

Figure 6:
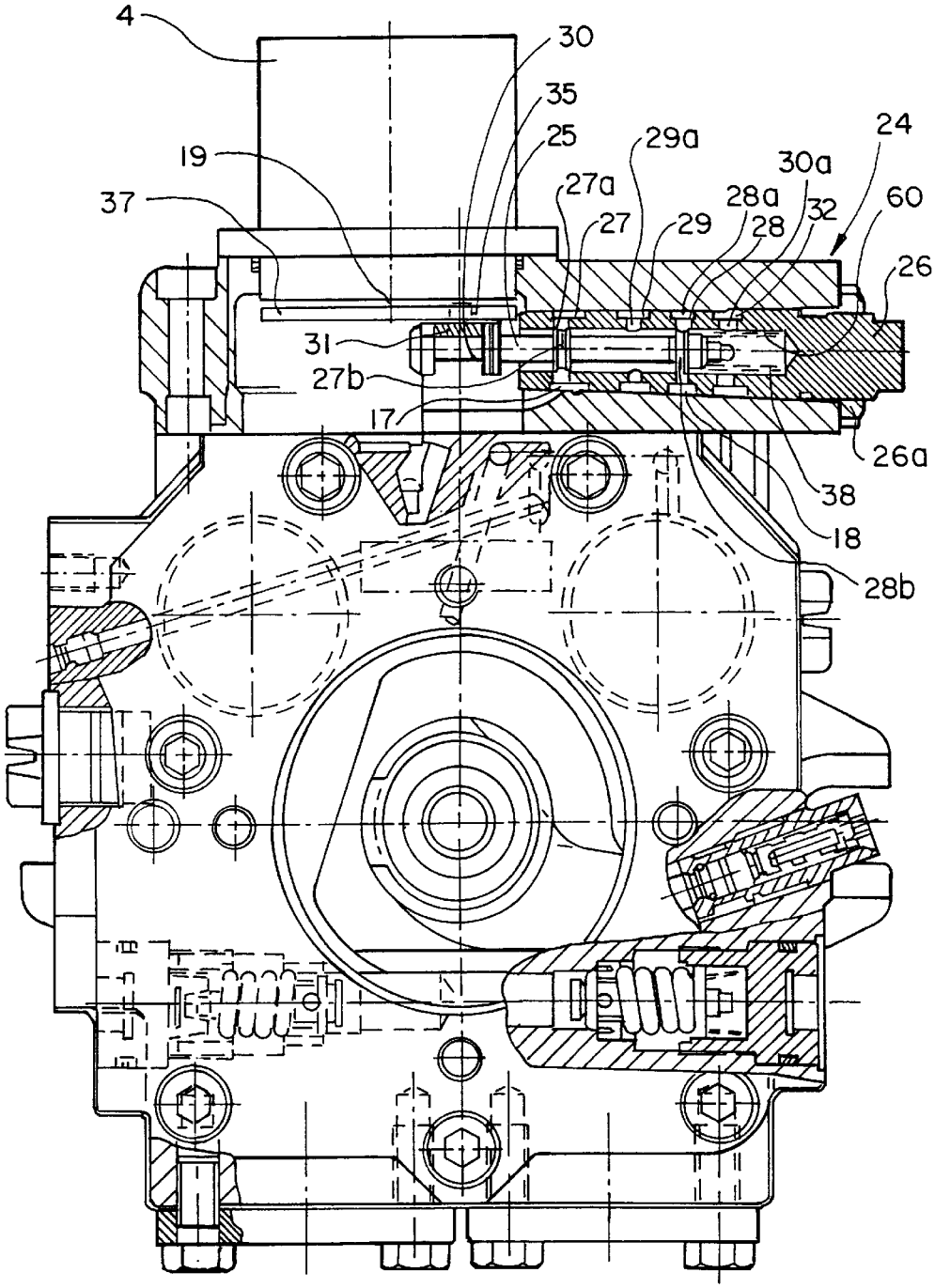
FIG. 6 shows a cross section view along line 5—5 in FIG. 5.

As shown in FIG. 6, the slide valve 24 has a valve body 25 which is mounted so that it can move longitudinally in a longitudinal boring 60 of a sleeve 26. On the outside periphery of the sleeve 26 there is a first annular groove 27 which is connected to a line 17 which leads to the regulating pistons. An additional annular groove 28 is connected to a line 18 which leads to the regulating pistons.

In the area between the annular grooves 27 and 28 there is an additional annular groove 29 which is pressurized with a supply pressure. An additional annular groove 32 located on the axial end of the longitudinal boring 60 is connected to a reservoir. From the annular grooves 27, 28, 29 and 32, transverse borings 27*a*, 28*a*, 29*a* and 30*a* lead into the interior of the sleeve 26. The borings 27*a* and 28*a* thereby form control edges which can be actuated by piston flanges 27*b* and 28*b* located on the valve body 25. The sleeve 26 can be adjusted by means of a screw 26*a* with respect to the valve body 25 and the zero position of the swash plate 5, and is secured against longitudinal movement.

To actuate the piston 25, there is an annular groove 30 in an area of the valve body 25 which projects out of the longitudinal boring 60 of the sleeve 26, in which annular groove 30 a driver element in the form of a lever 31 is engaged.

Figure 5:
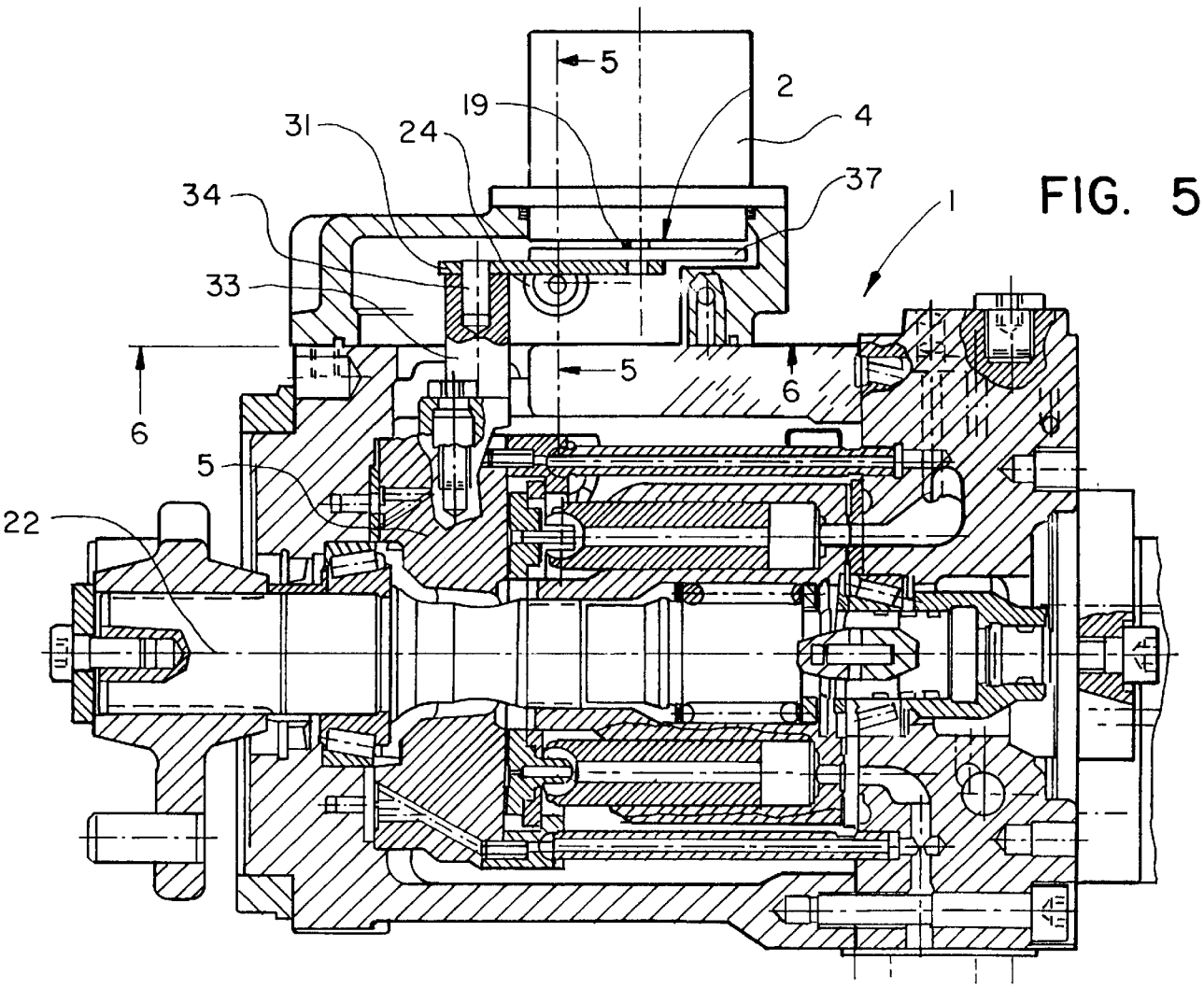
FIG. 5 shows an axial section view of an additional embodiment of an axial piston machine with a control valve in the form of a slide valve, similar to the view shown in FIG. 1.
Figure 7:
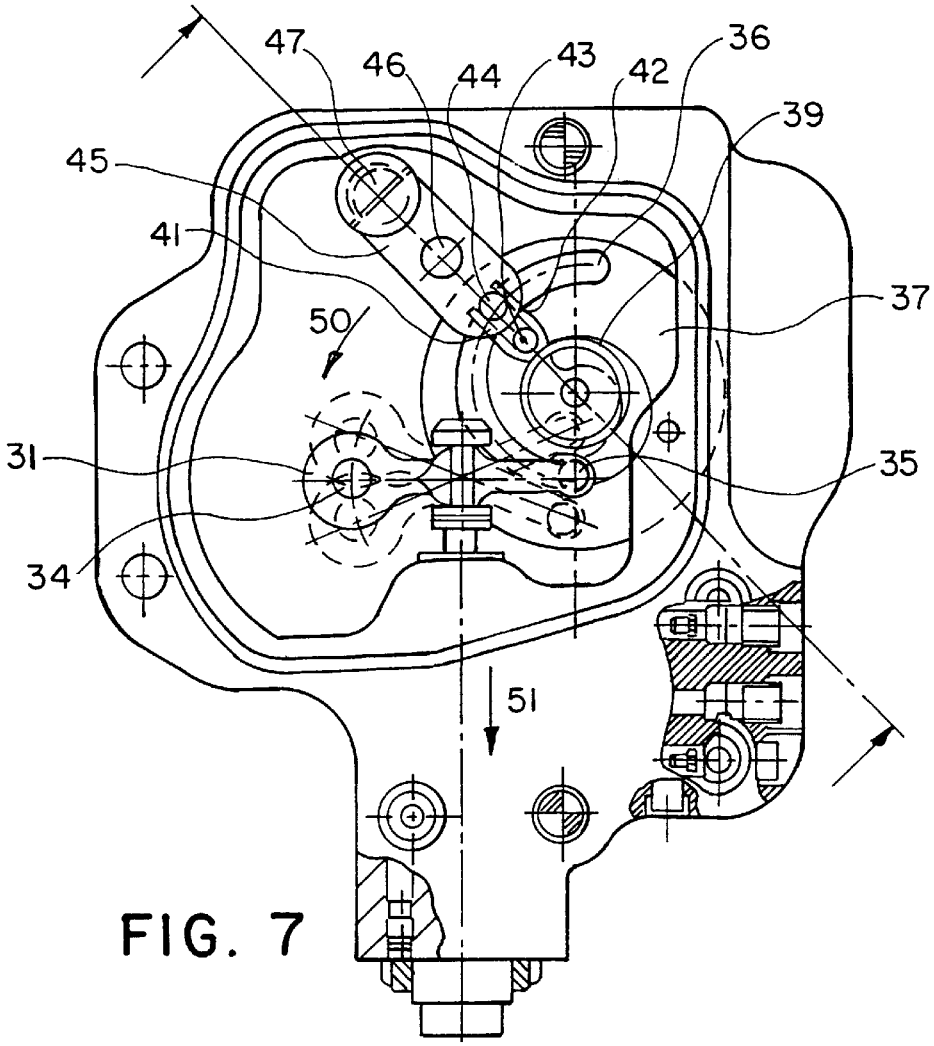
FIG. 7 shows a cross section view along line 6—6 in FIG. 5.

As shown in FIGS. 7 and 5, the lever 31 is connected on one end to a component 33 which is non-rotationally connected to the tilting yoke 5. For this purpose, there is a boring in each of the lever 31 and the component 33, which borings are connected to one another by a dowel pin 34. On the opposite end of the lever 31 there is a pin 35 which is guided in a link 36 in the form of a spiral-shaped groove in a cam plate 37. The central portion of the lever 31 which is engaged in the annular groove 30 of the valve body 25 thereby has rounded lateral surfaces. To ensure that the lever 31 is in contact with the groove walls of the annular groove 30, pressure is exerted on the valve body 25 by a spring 38 located inside the sleeve 26.

Figure 8:
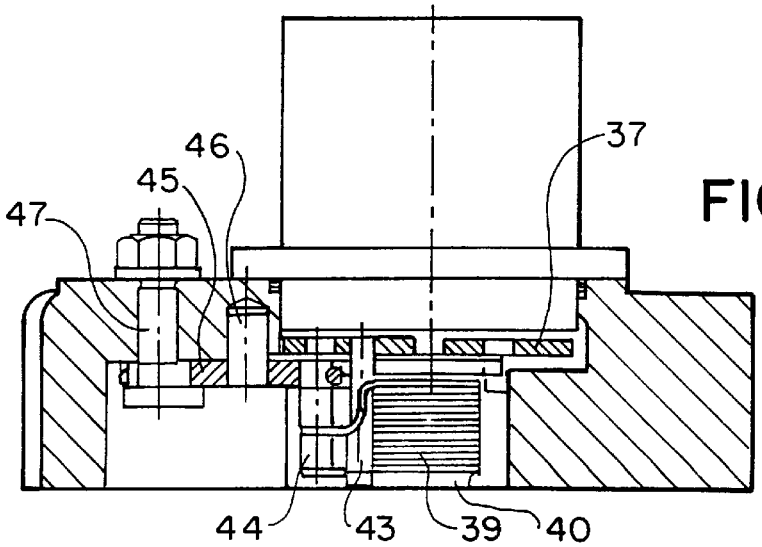
FIG. 8 shows a cross section view along line 7—7 in FIG. 7.

FIGS. 7 and 8 illustrate the location of a coil spring 39, the respective ends 41, 42 of which are connected to a pin 43 which is connected to a cam plate 37 and to a stop pin 44. In this case, the stop pin 44 is fastened to a plate 45 which is fastened by a dowel pin 46 and an eccentric bolt 47 to the housing of the axial piston machine. The eccentric bolt 47 can thereby be used to set the zero position of the slide valve 24, in which the piston flanges 27*b* and 28*b* cover the borings 27*a* and 28*a* respectively.

When the cam plate 37 moves as the result of an actuation of the stepper motor 4, for example in the direction 50, the lever 31 is rotated by the pin 35 guided in the link 36 around the end which is connected with the component 33. Because the tilting yoke 5 and the component 33 still do not execute any tilting movement, the valve body 25 is deflected in the direction 51 by the central portion of the lever 31 which is engaged in the annular groove 30. Consequently, the annular groove 27 which is connected with the line 17 is connected via the boring 27*a* and the piston flange 27*b* with the interior of the housing of the axial piston machine. Simultaneously, the annular groove 28 which is connected with the line 18 is connected via the transverse boring 28*a* and the piston flange 28*b* with the transverse boring 29*a* and the annular groove 29, so that the line 18 is pressurized with a control pressure and thus the regulating pistons deflect the tilting yoke 5. As a result of the deflection of the tilting yoke 5, the end of the lever 31 which is connected to the component 33 moves around the pin 35, which is not guided in the link 36, so that when the tilting angle of the tilting yoke 5 set on the stepper motor 4 coincides with the tilting angle reported by the lever 31, the slide valve 24 moves into the closed position.

The coil spring 39 ensures that the slide valve 24 is pushed into the closed position if there is no longer any signal being received at the stepper motor. The free end 41 of the spring which is fastened to the cam plate by the peg 43 is deflected in the direction 50, for example, when the stepper motor 4 is actuated, and stretches the coil spring 39. As soon as there is no longer any signal at the stepper motor, the peg 43 and thus the cam plate 37 are rotated back into the starting position by the force of the coil spring 39, whereupon the slide valve 24 moves into the closed position.

It will be apparent to those of ordinary skill in the art that various changes may be made to the present invention without departing from the spirit and scope thereof. The scope of the present invention is defined by the appended claims and equivalents thereof.

I claim:

1. A regulating device for a hydrostatic positive displacement unit, the device including a control valve which pressurizes regulating pistons which determine a stroke volume or a displacement volume of the positive displacement unit, wherein the control valve is a slide valve which can be actuated electrically, wherein the slide valve can be actuated by a stepper motor, further including a device which brings the slide valve into a zero position, wherein the device which brings the slide valve in the zero position is a coil spring which is orientated coaxially to the output shaft of the stepper motor and on the ends has two radially projecting ends, wherein between the ends of the coil spring there is a stop peg which is non-rotationally connected to the housing and a peg which is connected to the cam plate.

2. A regulating device for a hydrostatic positive displacement unit, the device including a control valve which pressurizes regulating pistons which determine a stroke volume or a displacement volume of the positive displacement unit, wherein the control valve is a slide valve which can be actuated electrically, wherein the slide valve can be actuated by a stepper motor, and wherein the longitudinal axis of the slide valve is orientated at right angles to the axis of rotation of the axial piston machine and to a tilting axis of a tilting yoke and the longitudinal axis of the stepper motor is orientated parallel to the axis of rotation of the axial piston machined.

3. A regulating device for a hydrostatic positive displacement unit, the device including a control valve which pressurizes regulating pistons which determine a stroke volume or a displacement volume of the positive displacement unit, wherein the control valve is a slide valve which can be actuated electrically, wherein the slide valve can be actuated by a stepper motor, wherein the slide valve has a valve body which can move longitudinally in a sleeve, wherein the valve body is connected to an output shaft of the stepper motor to produce a linear movement of the valve body, wherein the valve body has at least one piston flange which actuates an annular groove located on the sleeve and connected to the regulating piston.

4. The regulating device as claimed in claim 3, wherein the pressure can be applied to the valve body of the slide valve by a spring which is located inside the sleeve.

5. The regulating device as claimed in claim 3, further including a device which monitors a zero position of the output shaft.

6. The regulating device as claimed in claim 3, wherein the longitudinal axis of the slide valve is oriented at right angles to the axis of rotation of the axial piston machine and to a tilting axis of a tilting yoke and the longitudinal axis of the stepper motor is oriented parallel to the axis of rotation of the axial piston machine.

7. A regulating device for a hydrostatic positive displacement unit, the device including a control valve which pressurizes regulating pistons which determine a stroke volume or a displacement volume of the positive displacement unit, wherein the control valve is a slide valve which can be actuated electrically, wherein the slide valve can be actuated by a stepper motor, wherein an output shaft of the stepper motor is non-rotationally connected to a cam plate, and the cam plate is connected to a driver element which is provided for the actuation of the valve body.

8. The regulating device as claimed in claim 7, wherein the cam plate is a spiral-shaped groove which is connected to the driver element.

9. The regulating device as claimed in claim 8, wherein the cam plate has areas which have different gradients.

10. The regulating device as claimed in claim 7, wherein the driver element is a pin which is located in a transverse boring of the valve body and is engaged by a the portion projecting out of the transverse boring with the cam plate, wherein the sleeve is mounted so that it can move longitudinally in a housing boring, and a component which is non-rotationally connected to a tilting yoke is connected to the sleeve.

11. The regulating device as claimed in claim 10, wherein the sleeve is on the outside periphery with a groove in which the component which is non-rotationally connected to the tilting yoke is engaged.

12. The regulating device as claimed in claim 10, wherein the valve body has two piston flanges, each of which actuates an annular groove which is located on the sleeve and is connected to a regulating piston, wherein the valve body is housed so that it can move longitudinally in a longitudinal boring which runs all the way through the sleeve, wherein the longitudinal boring is in communication on the axial ends with the boring which is connected to a supply line, and the sleeve, in an area located between the annular grooves, has a notch which is connected to a reservoir, wherein the groove is in the area between the annular grooves on the sleeve, and the transverse boring is provided on the valve body.

13. The regulating device as claimed in claim 7, wherein the driver element is a lever which on one end has a pin which is engaged with the cam plate, and on the opposite end is connected to a component which is non-rotationally connected to a tilting yoke, wherein the valve body of the slide valve has an annular groove and the lever is located between the groove walls of the annular groove.

14. The regulating device as claimed in claim 13, wherein the valve body has two piston flanges, each of which actuates an annular groove which is located on the sleeve and is connected to a regulating piston, wherein the valve body is housed so that it can move longitudinally in a longitudinal boring which runs all the way through the sleeve, and the annular groove is molded on the valve body in an area which projects out of the longitudinal boring, wherein on the sleeve there is an annular groove which is connected to a supply line, which annular groove is located axially between the annular grooves which are connected to the regulating pistons and the longitudinal boring is in communication on its axial ends with a reservoir.

15. The regulating device as claimed in claim 7, further including a device which brings the slide valve into a zero position.

16. The regulating device as claimed in claim 15, wherein the device which brings the slide valve into the zero position is a coil spring which is oriented coaxial to the output shaft of the stepper motor and on the ends has two radially projecting ends, wherein between the ends of the coil spring there is a stop peg which is non-rotationally connected to the housing and a peg which is connected to the cam plate.

17. A regulating device for a hydrostatic positive displacement unit, the device including a control valve which pressurizes regulating pistons which determine the stroke volume or displacement volume of the positive displacement unit, wherein the control valve is a slide valve which can be actuated electrically, wherein the slide valve can be actuated by a stepper motor, wherein the slide valve and the stepper motor are located on the housing of the positive displacement unit.

18. The regulating device as claimed in claim 17, wherein the longitudinal axis of the slide valve is oriented at a right angle to the axis of rotation of the axial piston machine and to the tilting axis of the tilting yoke, and the longitudinal axis of the stepper motor is oriented parallel to the tilting axis of the tilting yoke.

* * * * *

UNITED STATES PATENT AND TRADEMARK OFFICE

CERTIFICATE OF CORRECTION

PATENT NO. : 6,048,176

DATED : April 11, 2000

INVENTOR(S) : Horst Deininger

It is certified that error appears in the above-identified patent and that said Letters Patent is hereby corrected as shown below:

Column 1 Line 59 after "is reflected" insert --in--.

Column 8 Line 58, Claim 2, "machined" should read --machine--.

Column 9 Line 34 "by a the" should read --by the--.

Signed and Sealed this

Twenty-seventh Day of February, 2001

Nicholas P. Godici

*Attest:*

NICHOLAS P. GODICI

*Attesting Officer*

*Acting Director of the United States Patent and Trademark Office*